US007647857B2

(12) United States Patent
Gaigler et al.

(10) Patent No.: US 7,647,857 B2
(45) Date of Patent: Jan. 19, 2010

(54) ELECTRO MAGNETIC RESTRAINT MECHANISM

(75) Inventors: Randy L. Gaigler, Parkville, MD (US); Leszek Stanislaw Basak, Nottingham, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 308 days.

(21) Appl. No.: 11/773,146

(22) Filed: Jul. 3, 2007

(65) Prior Publication Data

US 2009/0007764 A1 Jan. 8, 2009

(51) Int. Cl.

| | |
|---|---|
| ***F41F 1/00*** | (2006.01) |
| ***F41F 3/04*** | (2006.01) |
| ***F41A 19/00*** | (2006.01) |
| ***F41B 6/00*** | (2006.01) |

(52) U.S. Cl. ..... 89/8; 89/1.806; 89/135; 42/84; 124/3

(58) Field of Classification Search ..... 89/1.806, 89/8, 28.05, 28.1, 135; 42/84; 124/3, 32
See application file for complete search history.

(56) References Cited

U.S. PATENT DOCUMENTS

| | | | | |
|---|---|---|---|---|
| 2,037,129 | A * | 4/1936 | Hilts | 89/28.05 |
| 5,076,136 | A * | 12/1991 | Aivaliotis et al. | 89/8 |
| 7,340,986 | B1 * | 3/2008 | Gaigler | 89/1.806 |
| 2006/0288853 | A1 * | 12/2006 | Frasca | 89/8 |

* cited by examiner

*Primary Examiner*—Stephen M Johnson
*Assistant Examiner*—Daniel J Troy
(74) *Attorney, Agent, or Firm*—DeMont & Breyer, LLC

(57) ABSTRACT

A restraint for immobilizing a projectile with respect to its launch system is disclosed. When electromagnetic force is applied to the restraint, the restraint releases the projectile, thereby enabling its launch.

16 Claims, 6 Drawing Sheets

ELECTRO MAGNETIC RESTRAINT MECHANISM

CROSS REFERENCE TO RELATED APPLICATIONS

The underlying concepts, but not necessarily the language, of the following cases are incorporated by reference:

(1) U.S. patent application Ser. No. 10/899,234, filed 26 Jul. 2004;

(2) U.S. patent application Ser. No. 11/278,988, filed 7 Apr., 2006; and (3) U.S. patent application Ser. No. 11/753,426, filed May 23, 2007.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to munitions in general, and, more particularly, to munition launchers.

BACKGROUND OF THE INVENTION

Projectiles, such as guided missiles, mortar rounds, and the like, are often stored, shipped, and carried to their point of deployment in canisters. Among other things, a canister protects a projectile from harsh environmental conditions. A typical canister comprises a launch tube that guides the projectile as it is launched, much like the launch tube of a gun. At deployment, the projectile is propelled from its canister using either its self-propulsion engine or by external means such as an electromagnetic launcher, compressed gas, mechanical catapult, and the like.

Typically, each projectile is secured within its canister by a mechanical release restraint in order to avoid damage during transport. In order to launch the projectile, the restraint is actuated to release it from its canister. This enables the projectile to be propelled from the canister. Restraints known in the prior-art include explosive bolts, marmon clamps, bullet jackets, and shape charges.

These restraints have several drawbacks, however. First, they require proactive actuation in the form of electromechanical, motor driven, or explosives. As a result, additional infrastructure and/or control signals are required to make them release their projectile. This increases the complexity and cost of the launch systems in which they are employed.

Second, many canisters are designed with reload capability so that they can be reused to launch additional projectiles. Since many of these restraints leave residue or other material behind after their actuation during the launch of their projectile. This residual material must be removed prior to a subsequent launch. For systems capable of multiple launches, therefore, the time between consecutive launches is increased. This decreases the overall firepower of the launch system. In addition, additional labor and/or personnel are required to remove the residual material.

Finally, the need to proactively actuate these prior-art restraints leads to a reliability issue. If an actuation signal is not sent to the restraint, or the actuation signal is not received by the restraint, a catastrophic accident, such as the detonation of a projectile within its canister, can ensue.

Therefore, the need exists for a restraint that avoids or mitigates some or all of these problems.

SUMMARY OF THE INVENTION

The present invention provides a mechanical release restraint for securing a projectile within a launch system without some of the costs and disadvantages associated with restraints known in the prior art.

An embodiment of the present invention comprises a restraint comprising one or more pins for securing a projectile within its canister. In the absence of an electromagnetic field, the pins engage features of the launch tube. As a result, the pins immobilize the projectile with respect to the launcher. In some embodiments, circular pins engage circular seats to immobilize the projectile in at least two dimensions. In some embodiments, the restraint is a part of the projectile itself. In some embodiments, the restraint is installed on another structure, such as an armature, that is located within the launcher.

In some embodiments, the restraint comprises a plurality of pins, each of which mates with a seat located on the canister. When electromagnetic force is applied to the restraint, the pins are disengaged from their respective seats, thereby enabling the projectile to move with respect to the launch tube. For some embodiments that utilize an electromagnetic field to induce a propulsive force on the projectile, the restraint is passively actuated by forces induced by the same electromagnetic field. The present invention is particularly well-suited for electromagnetic launch systems. In some embodiments wherein the restraint is used with an electromagnetic launcher, the restraint is passively actuated by electromagnetic energy generated by a drive coil or drive coils of the launcher to propel a projectile from the launcher.

In some embodiments, a dedicated actuation coil is employed for actuating the restraint. In some embodiments, one or more drive coils serve the purpose of a dedicated actuation coil.

In some embodiments, the restraint is a part of a projectile itself. As a result, no residual matter is left in the launch system after the projectile is launched.

In some embodiments, the restraint immobilizes an armature that is used to propel a projectile from a launch tube. In some embodiments, the armature propels a projectile from its launch tube with only the use of electromagnetic force.

An embodiment of the present invention comprises: (1) an armature for propelling a projectile along a line; (2) a guide for guiding the armature along the line; (3) a propulsion system for producing an electromagnetic field to propel the armature along the line; and (4) a restraint for immobilizing the armature along the line in the absence of the electromagnetic field and enabling the motion of the armature along the line in the presence of the electromagnetic field, wherein the restraint comprises; (a) a plurality of pins for engaging the guide in the absence of the electromagnetic field; and (b) a continuous loop of electrically-conductive material, wherein the continuous loop physically deforms in the presence of the electromagnetic field, and wherein the continuous loop and the plurality of pins are operatively-coupled such that a deformation of the continuous loop induces the plurality of pins to disengage from the guide.

DETAILED DESCRIPTION

The following terms are defined for use in this Specification, including the appended claims:

Physically-connected means in direct, physical contact and affixed (e.g., a mirror that is mounted on a linear-motor).

Physically-coupled means in direct, physical contact, although not necessarily physically-connected (e.g., a coffee cup resting on a desktop).

Projectile means an object that is fired, thrown, or otherwise propelled. Examples of projectiles include, without limitation, artillery shells, mortar rounds, self-propelled missiles, guided missiles, and countermeasure devices, such as flares, chaff, acoustic emitters, IR emitters, and the like.

Figure 1:
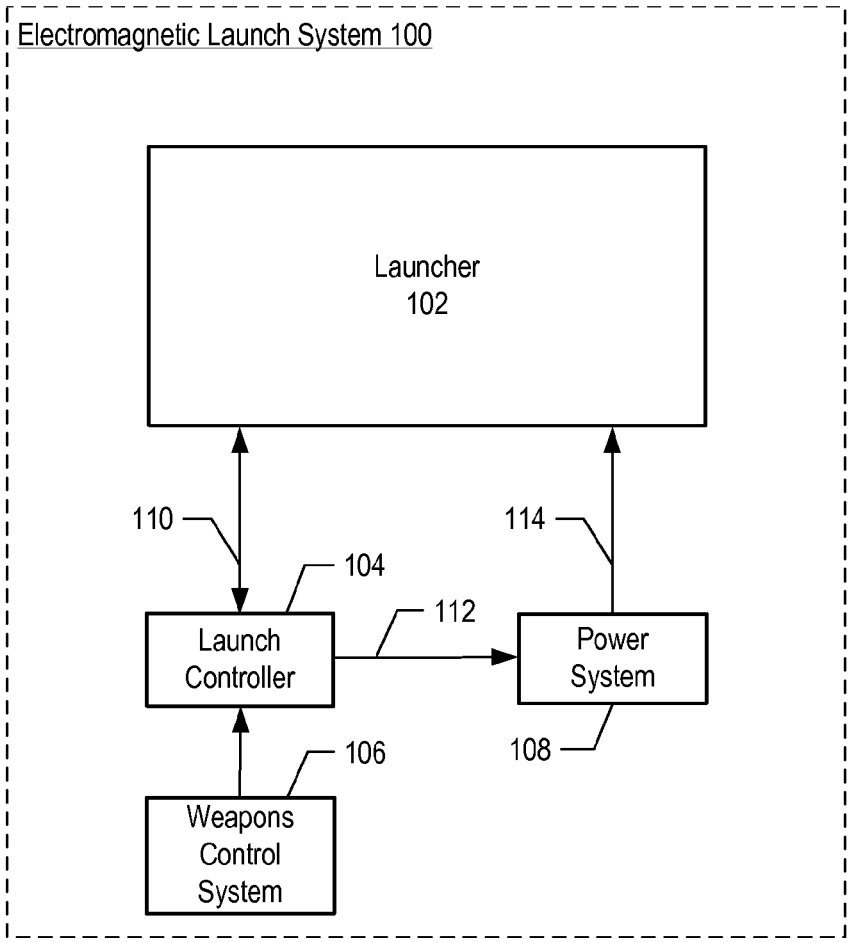
FIG. 1 depicts a schematic diagram of an electromagnetic launch system in accordance with an illustrative embodiment of the present invention.

FIG. 1 depicts a schematic diagram of an electromagnetic launch system in accordance with an illustrative embodiment of the present invention. Launch system 100 comprises launcher 102, launch controller 104, weapons control system 106, power system 108, control cable 110, signal line 112, and current cable 114.

Launcher 102 is a system that has the capability to house and expel one or more projectiles upon command. In the illustrative embodiment launcher 102 expels a guided missile comprising a chemical-propulsion engine. Launcher 102 expels the guided missile from its associated launch cell using an electromagnetic catapult, and without the aid of the missile's chemical-propulsion engine. It will be clear to those of ordinary skill in the art, however, after reading this specification, how to make and use alternative embodiments of the present invention wherein launcher 102 expels a projectile by means of non-electromagnetic propulsion, such as chemical propellants, compressed air, pneumatics, mechanical force, and the like. In some embodiments, launcher 102 employs the self-propulsion means of the projectile, such as a chemical-propellant engine, to expel, or help expel, each missile. In some embodiments, launcher 102 is capable of propelling munitions that have no self-propulsion, such as artillery shells, mortar rounds, unmanned aerial vehicles, countermeasure devices, and the like. In some embodiments, launcher 102 comprises apparatus for controlling the azimuth and elevation at which a projectile is launched.

Although in the illustrative embodiment electromagnetic launch system 100 comprises a launcher having a single launch cell, it will be clear to those skilled in the art, after reading this specification, how to make and use alternative embodiments of the present invention wherein launcher 102 comprises more than one launch cell.

Launch controller 104 provides the targeting and flight information to a missile prior to launch and the directive to launch to power system 108.

Weapons control system 106 provides targeting and flight information and firing authority to launch controller 104 prior to and during a launch sequence. It will be clear to those skilled in the art, after reading this disclosure, how to make and use weapons control system 106.

Power system 108 comprises circuitry that conditions and manages the storage and delivery of power to, and the recovery of power from, launcher 102 in response to signals from launch controller 104. Power system 108 controls power generation, scavenging, storage, and delivery prior to, during, and after each launch. Power system 108 is described in detail in U.S. patent application Ser. No. 10/899,234, filed on 26 Jul., 2004, which is incorporated by reference herein.

Control cable 110 carries the targeting information from launch controller 104 to the missile.

Signal line 112 connects launch controller 104 to power system 108 and carries the commands that direct power system 108 to initiate and control the launch of a missile.

Current cable 114 carries power from power system 108 to launcher 102. In some embodiments of the present invention that comprise multiple launch cells, current cable 114 is capable of carrying power to each launch cell independently from the other launch cells.

Figure 2:
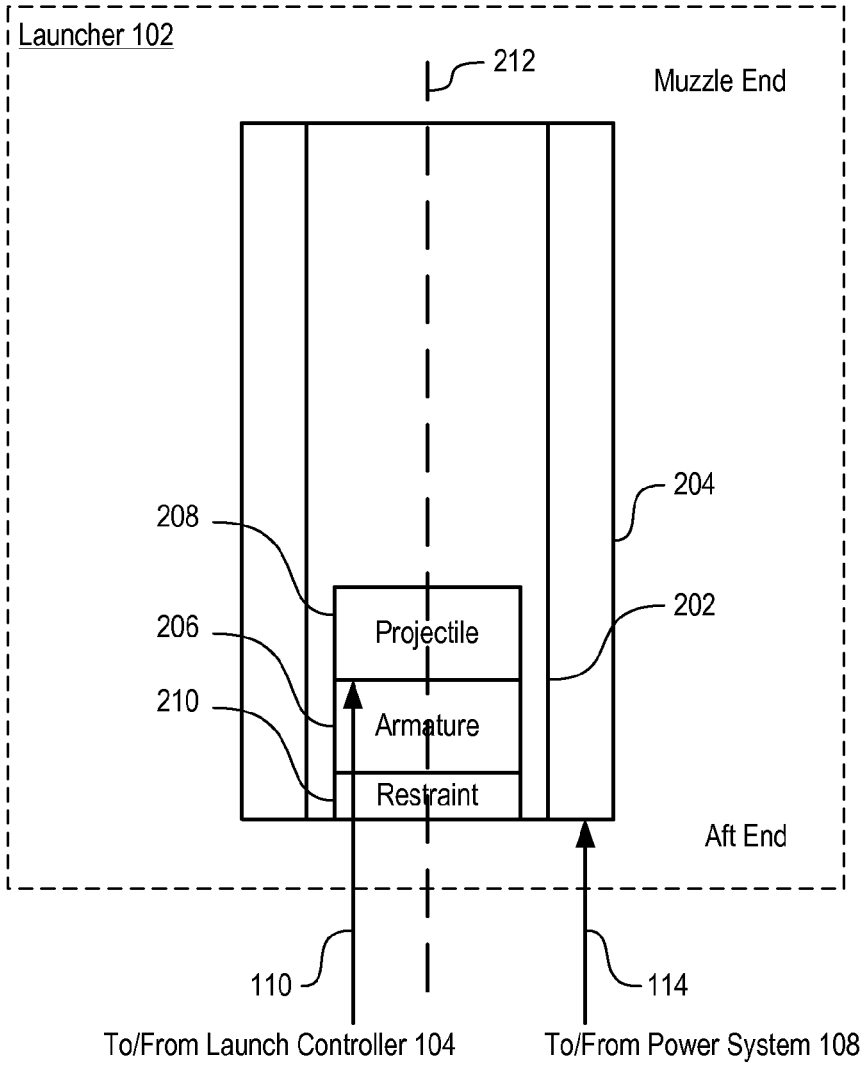
FIG. 2 depicts a schematic diagram of details of a launcher in accordance with the illustrative embodiment of the present invention.

FIG. 2 depicts a schematic diagram of details of a launcher in accordance with the illustrative embodiment of the present invention. Launcher 102 comprises launch tube 202, electromagnetic catapult 204, armature 206, missile 208, and restraint 210.

Launch tube 202 is a cylindrical tube that has sufficient interior diameter to accommodate missile 208, armature 206, and restraint 210, and sufficient strength to withstand the forces exerted on launch tube 202 during a missile launch. Launch tube 202 is formed of material that is non-magnetic so that it does not perturb mutual induction between electromagnetic catapult 204 and either of armature 206 or restraint 210. Launch tube 202 guides armature 206 as it propels missile 208 along launch axis 212 during a launch.

Electromagnetic catapult 204 is a powerful electromagnet comprising a series of electrically-conductive drive coils. Electromagnetic catapult 204 is powered and controlled by power system 108 via cable 114.

Armature 206 comprises a rigid platform and a coil of electrically-conductive material. Armature 206, electromagnetic catapult 204, and power system 108 together compose an electromagnetic propulsion system. When electric current flows in electromagnetic catapult 204, a mutual inductance between electromagnetic catapult 204 and armature 206 results in a force directed upon armature 206. This force causes armature 206 to accelerate and propel missile 208 out of launch tube 202. Armature 206 accelerates missile 208 to a velocity sufficient for missile 208 to attain aerodynamic flight after exiting launch tube 202. In some embodiments, armature 206 comprises a conductive material. In some embodiments, armature 206 comprises a ferromagnetic material. In some embodiments, missile 208 acts as its own armature and no separate armature is necessary.

Restraint 210 comprises a plurality of pins, each of which is operatively-coupled to a continuous loop of electrically conductive material. Prior to the flow of electric current in electromagnetic catapult 204, these pins are engaged with features located in launch tube 202. As a result, restraint 210 immobilizes armature 206 with respect to launch tube 202. The continuous loop is suitable for establishing a mutual inductance with electromagnetic catapult 204. When an electric current flows in electromagnetic catapult 204, a mutual inductance between electromagnetic catapult 204 and the continuous loop of restraint 210 causes the continuous loop to deform. When the continuous loop deforms, it causes the pins to disengage from launch tube 202, and thereby release armature 206. In the illustrative embodiment, restraint 210 releases armature 206 when electromagnetic catapult 204 is energized in order to propel armature 206. In other words, restraint 210 actuates passively when electromagnetic catapult 204 is energized to propel armature 206. In some embodiments, restraint 210 is designed to actuate only if electromagnetic catapult 204 is energized sufficiently to propel missile 208 with enough force to clear launch tube 202.

Figure 3:
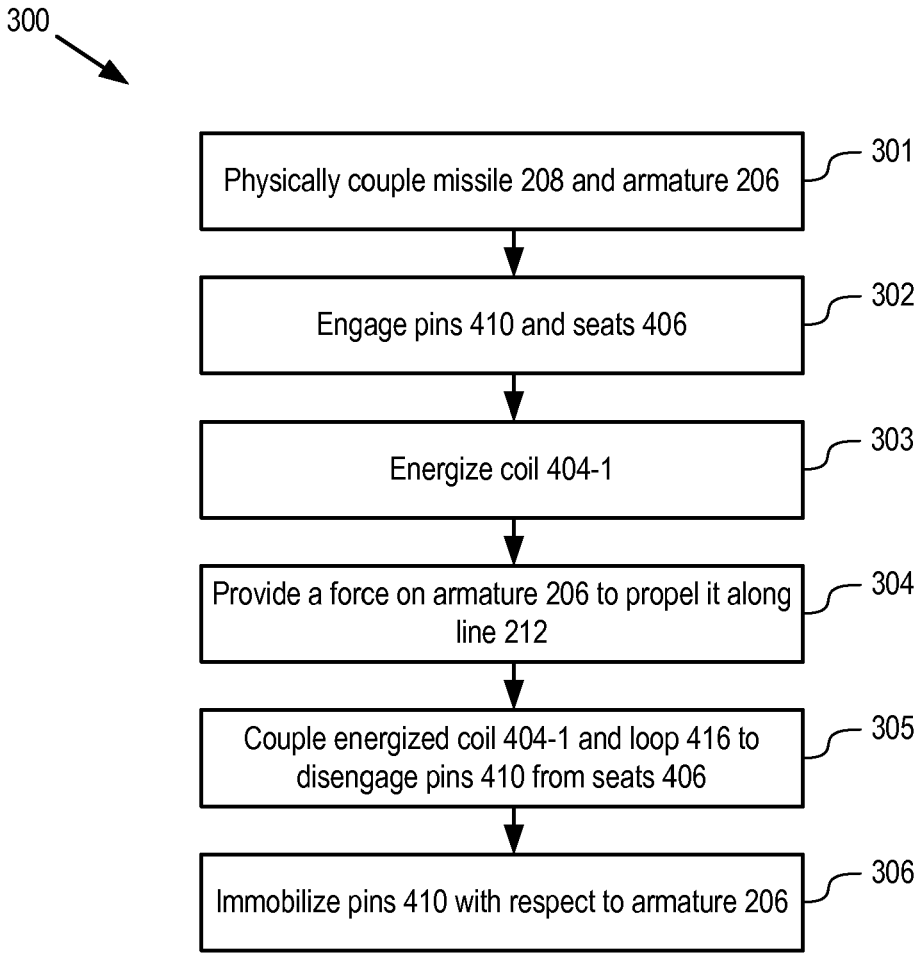
FIG. 3 depicts a method for launching a projectile in accordance with the illustrative embodiment of the present invention.

FIG. 3 depicts a method for launching a projectile in accordance with the illustrative embodiment of the present invention. Method 300 is described herein with reference to FIGS. 4A, 4B, and 5.

Figure 4A:
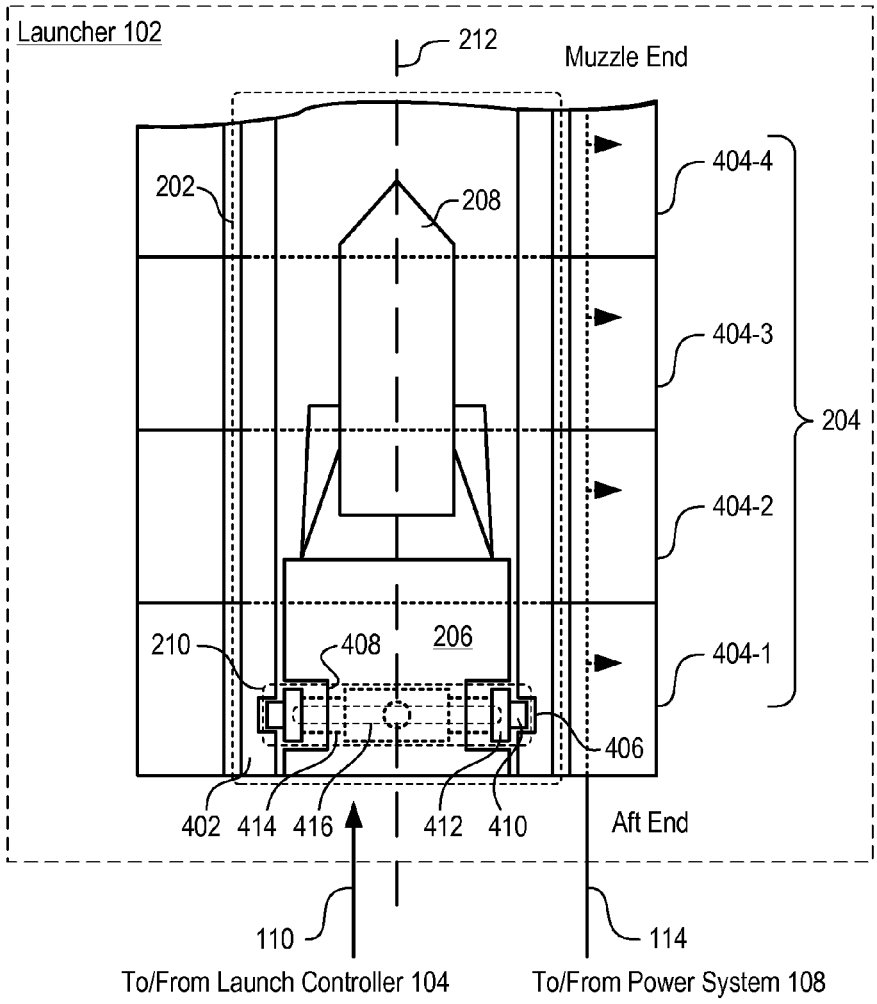
FIG. 4A depicts a cross-sectional view showing details of a portion of a launcher prior to commencement of a launch in accordance with the illustrative embodiment of the present invention.

FIG. 4A depicts a cross-sectional view showing details of a portion of a launcher prior to commencement of a launch in accordance with the illustrative embodiment of the present invention.

Launcher 102 comprises launch tube 202, electromagnetic catapult 204, armature 206, missile 208, and restraint 210.

Launch tube 202 comprises launch tube wall 402. Launch tube wall 402 guides armature 206 and missile 208 as they travel along launch axis 212 during a launch. In some embodiments, launch tube 202 also forms a part of a canister that provides a substantially air-tight environment for missile 208. Launch tube wall 402 also comprises seats 406 for receiving pins 410 and immobilizing armature 206 with respect to launch tube 202.

Method 300 begins with operation 301, wherein armature 206 and missile 208 are physically coupled. In some embodiments, the missile and armature are bolted together with explosive bolts, marmon clamps, or the like. In some embodiments, a restraint in accordance with the present invention in used to physically couple armature 206 and missile 208. Prior to, and during, a launch, missile 208 remains in communication with launch controller 104 through control cable 110, which pays out during the travel of armature 206 through launch tube 202. For clarity, the connection between control cable 110 and missile 208 is not shown in FIGS. 4A and 4B.

At operation 302, seats 406 receive pins 410 to immobilize armature 206 with respect to launch tube 202.

Figure 4B:
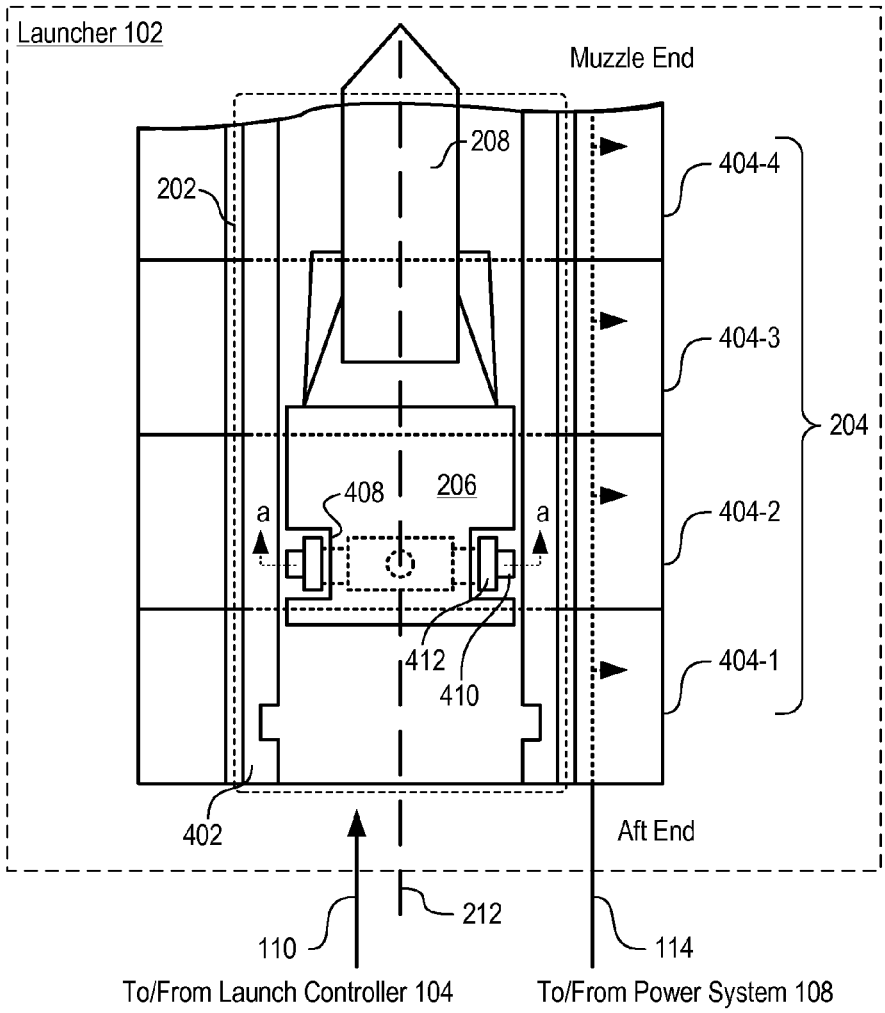
FIG. 4B depicts a cross-sectional view showing details of a portion of a launcher after commencement of a launch in accordance with the illustrative embodiment of the present invention.

Electromagnetic catapult 204 comprises a plurality of individually-addressable electrically-conductive drive coils, referred to collectively as drive coils 404. FIGS. 4A and 4B depict only four (4) such drive coils, drive coils 404-1 through 404-4. The number of individual drive coils used is a matter of design choice and varies with the application for which electromagnetic catapult 204 is intended.

Armature 206 comprises collar 408, which provides structure for locating restraint 210.

Restraint 210 comprises pins 410, shoulders 412, and conductive strips 414, each of which is made of a material that is electrically conductive. FIGS. 4A and 4B depict only four (4) pins 410 and four (4) shoulders 412. The number of individual pins and shoulders used is a matter of design choice and varies with the application for which electromagnetic catapult 204 is intended. Shoulders 412 and conductive strips 414 are electrically-connected to collectively define loop 416, which is a continuous loop of electrically conductive material. Loop 416 will be described in more detail below and with reference to FIG. 5. Materials suitable for use in pins 410, shoulders 412, and conductive strips 414 include, without limitation, steel, aluminum, copper, conductive polymers, and the like. In some embodiments, pins 410 are formed of a material that is not electrically conductive.

At operation 303, power system 106 energizes drive coil 404-1 with electric current via current cable 114. The flow of electric current in drive coil 404-1 causes a mutual inductance between drive coil 404-1 and armature 206.

At operation 304, the mutual inductance between drive coil 404-1 and armature 206 results in a force that acts to propel armature 206 toward the muzzle end of launch tube 202.

At operation 305, the flow of electric current in drive coil 404-1 causes a mutual inductance between drive coil 404-1 and loop 416. The mutual inductance between drive coil 404-1 and loop 416 results in a force directed on each pin 410. The force on each pin 410 is directed normally on the face of each pin, thereby forcing the pin to retract into the armature 206. As a result, each pin 410 disengages from its respective seat 406 and armature 206 is no longer immobilized with respect to launch tube 202 and launch axis 212. Thus, armature 206 is enabled to accelerate toward the muzzle end of launch tube 202 and thereby propel missile 208.

FIG. 4B depicts a cross-sectional view showing details of a portion of a launcher after commencement of a launch in accordance with the illustrative embodiment of the present invention.

As armature 206 moves toward the muzzle end of launcher 102, power system 106 sequences the flow of electric current from stackable drive coil 404-1 to stackable drive coil 404-2 and then to stackable drive coil 404-3.

At operation 306, a latch 502 engages each pin 410 after it has retracted. In some embodiments, latches 502 engage pins 410 once they have completely retracted into the body of armature 206. The sequencing of the flow of electric current serves to continue the acceleration of armature 206 and missile 208 so as to impart sufficient velocity to the missile for it to achieve aerodynamic flight. In some embodiments, as the flow of electric current sequences between drive coils 404, the force that causes pins 410 to retract is maintained as armature 206 travels along launch axis 212. In some embodiments the inclusion and use of latch 502 is optional.

Although in the illustrative embodiment, the energizing of drive coil 404-1 both propels armature 206 and actuates restraint 210, it will be clear to those of ordinary skill in the art, after reading this specification, how to make and use alternative embodiments of the present invention wherein restraint 210 is actuated by a drive coil that does not also propel an armature and/or projectile. Embodiments of the present invention, therefore, may be used with launchers that propel a projectile by non-electromagnetically-generated force.

Figure 5:
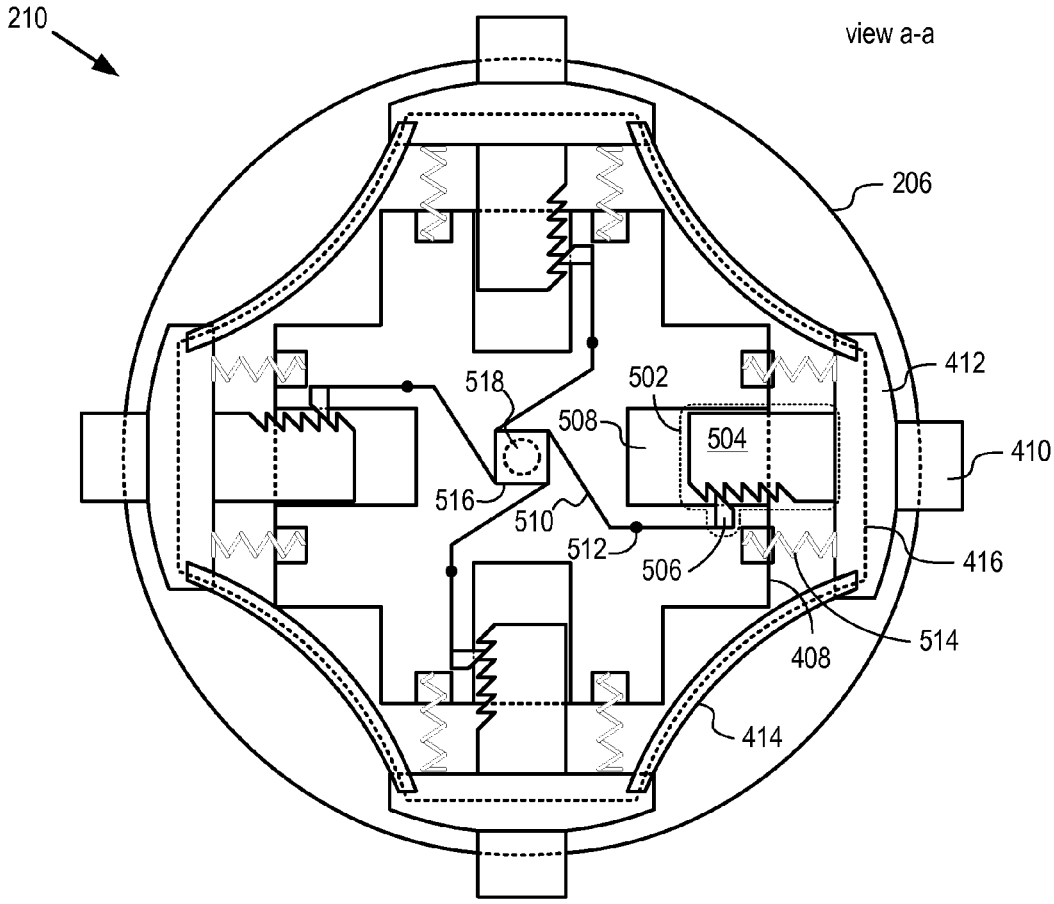
FIG. 5 depicts a cross-sectional view of details of restraint 210 in accordance with the illustrative embodiment of the present invention.

FIG. 5 depicts a cross-sectional view of details of restraint 210 in accordance with the illustrative embodiment of the present invention. The cross-sectional view depicted in FIG. 5 is taken through line a-a as shown in FIG. 4B. Restraint 210 comprises armature 206, loop 416, latch release 516, and four substantially identical pin/latch mechanisms. Each pin/latch mechanism comprises a pin 410, latch 502, spring 514, and lever arm 510. Some embodiments of the present invention comprise fewer than four pin/latch mechanisms. Some embodiments comprise more than four pin/latch mechanisms.

Loop 416 comprises shoulders 412 and conductive strips 414, which collectively define a continuous circuit of electrically conductive material. Loop 416 is suitable for establishing a mutual inductance with drive coils 404.

Each of latches 502 comprises a rack 504 and pawl 506. Each rack 504 and pawl 506 together form a ratchet that enables a pin 410 to retract into the interior of armature 206, but disables the pin from returning toward its original position. A lever arm 510 exerts a force on each pawl 506 to ensure it engages with its respective rack 504. Lever arms 510 comprise a strip of spring steel or composite material of suitable strength for forcing pawl 506 into engagement with rack 504.

It will be clear to those of ordinary skill in the art, after reading this specification, how to make and use alternative embodiments of the present invention wherein a mechanism other than latch 502 immobilizes pin 410 after it has retracted from its original position.

Latch release 516 is a rotation element that comprises an attachment point for each of lever arms 510. When latch release 516 rotates within shaft 518, each lever arm 510 pivots about its respective pivot point 512. This causes each pawl 506 to disengage from its respective rack 504. As a result of the actuation of latch release 516, each of pins 410 is enabled to move. A pair of springs 514 provides a restoring force that acts to move each pin back toward its original position. Some embodiments do not include latch release 516.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus comprising:

(1) an armature for propelling a projectile along a line;

(2) a guide for guiding the armature along the line;

(3) a propulsion system, wherein the propulsion system produces an electromagnetic field for propelling the armature along the line;

(4) a restraint for immobilizing the armature along the line in the absence of the electromagnetic field and enabling the motion of the armature along the line in the presence of the electromagnetic field, wherein the restraint comprises;

(a) a plurality of pins for engaging the guide; and (b) a continuous loop of electrically-conductive material, wherein the continuous loop physically deforms in the presence of the electromagnetic field, and wherein the continuous loop and the plurality of pins are operatively-coupled such that a deformation of the continuous loop disengages the plurality of pins from the guide.

2. The apparatus of claim 1 further comprising the projectile.

3. The apparatus of claim 2 wherein the projectile comprises the armature.

4. The apparatus of claim 2 wherein the projectile includes the armature and the restraint.

5. The apparatus of claim 1 wherein the restraint further comprises a plurality of latches for immobilizing the plurality of pins with respect to the restraint when the plurality of pins are disengaged from the guide.

6. The apparatus of claim 5 further comprising a latch release for enabling motion of the plurality of pins relative to the restraint when the pins are disengaged from the guide, wherein the latch release is operatively-coupled to each of the plurality of latches.

7. The apparatus of claim 1 wherein the armature comprises the restraint.

8. An apparatus comprising:

an armature for propelling a projectile along a line, wherein the armature comprises a continuous loop of electrically conductive material;

a guide for guiding the armature along the line;

a propulsion system for propelling the armature along the line;

a restraint comprising a first pin that is operatively-coupled to the continuous loop, wherein the first pin has a first position for substantially immobilizing the armature with respect to the guide, and further wherein the first pin has a second position for enabling motion of the armature with respect to the guide; and a first coil for producing an electromagnetic field, wherein the electromagnetic field couples to the armature to induce the continuous loop to move the first pin from its first position to its second position.

9. The apparatus of claim 8 wherein the propulsion system comprises the first coil, and wherein the electromagnetic field couples to the armature to induce the propulsion of the armature along the line.

10. The apparatus of claim 8 further comprising a first latch for immobilizing the first pin is in its second position.

11. The apparatus of claim 8 wherein the restraint further comprises a second pin that is operatively-coupled to the continuous loop, and wherein the second pin has a first position in which it substantially immobilizes the armature with respect to the guide, and wherein the second pin has a second position in which it enables motion of the armature with respect to the guide, and further wherein the electromagnetic field couples to the continuous loop to induce the continuous loop to move the second pin from its first position to its second position.

12. The apparatus of claim 11 further comprising:

a second latch for immobilizing the second pin in its second position; and a release, wherein the release is operatively-coupled to the first latch and the second latch, and wherein actuation of the release enables the first pin to return to its first position and the second pin to return to its first position.

13. The apparatus of claim 8 further comprising the projectile, wherein the projectile is selected from the group consisting of guided missiles, munitions, unmanned vehicles, flares, and countermeasures.

14. The apparatus of claim 8 further comprising the projectile, wherein the projectile comprises the armature.

15. The apparatus of claim 8 wherein the guide comprises a first seat for mating with the first pin.

16. An electromagnetic launcher comprising:

(1) a propulsion system for producing an electromagnetic field to propel a projectile along a line; and (2) the projectile, wherein the projectile comprises;

(a) an armature having a continuous loop of electrically conductive material; and (b) a restraint comprising;

(i) a plurality of pins for engaging the propulsion system to immobilize the projectile along the line; and (ii) a plurality of latches for immobilizing the plurality of pins when the plurality of pins are disengaged from the propulsion system;

wherein the plurality of pins are operatively-coupled to the continuous loop; and wherein the continuous loop deforms in the presence of the electromagnetic field to disengage the plurality of pins from the propulsion system.

* * * * *